US005517730A

United States Patent [19]

Ho

[11] Patent Number: 5,517,730

[45] Date of Patent: May 21, 1996

[54] CROWN BUTTON OF A CAP

[76] Inventor: Wen-Lung Ho, No. 30-1, Ta-Chuan St., Taichung, Taiwan

[21] Appl. No.: 288,692

[22] Filed: Aug. 12, 1994

[51] Int. Cl.[6] ..... A44B 1/12; A44B 1/38

[52] U.S. Cl. ..... 24/92; 24/108; 24/90.1; 24/113 R; 24/113 MP

[58] Field of Search ..... 24/90.1, 92, 103, 24/108, 94, 113 R, 113 MP; 40/301

[56] References Cited

U.S. PATENT DOCUMENTS

| | | | |
|---|---|---|---|
| 3,725,980 | 4/1973 | Burgio | 24/108 |
| 4,387,488 | 6/1983 | Kanzaka | 24/92 X |
| 4,481,696 | 11/1984 | Kanzaka | 24/113 R |
| 4,541,148 | 9/1985 | Watanabe | 24/92 X |
| 4,607,415 | 8/1986 | Fukuroi | 24/92 X |
| 4,654,934 | 4/1987 | Hasegawa | 24/92 X |
| 4,928,362 | 5/1990 | Collas et al. | 24/94 X |

*Primary Examiner*—Peter M. Cuomo
*Assistant Examiner*—Robert J. Sandy
*Attorney, Agent, or Firm*—Browdy and Neimark

[57] ABSTRACT

A cap crown button comprises a female retaining body, a decorating cloth, a fastening element, and a male retaining body. The female retaining body has an arcuate top, a periphery and a receiving space provided centrally with a projection having an axial hole which is provided therein with a shoulder. The projection has a belly portion. The female retaining body is covered with the decorating cloth. The fastening element is located in the receiving space such that the fastening element fastens the decorating cloth which extends into the receiving space. The male retaining body comprises a disklike bottom and a nail having thereon a tapered head capable of piercing the cap crown to engage the axial hole of the projection of the female retaining body.

5 Claims, 2 Drawing Sheets

CROWN BUTTON OF A CAP

FIELD OF THE INVENTION

The present invention relates generally to a cap, and more particularly to a cap crown button disposed at the center of the top of a cap crown for holding together the upper ends of the gores making up the crown of a cap.

BACKGROUND OF THE INVENTION

As shown in FIG. 1, a conventional crown button of the cap is generally made of a metal material by punching and pressing and is composed of a top piece 11, a guide piece 12, a receiving piece 13, a nail 14, and a base seat 15. A male member is formed by the nail 14 which is disposed in the base seat 15 such that the nail 14 is located by a press portion 15*a*. The guide piece 12 is fastened to the receiving piece 13. The top piece 11 is covered with a piece of cloth 16 having an end extending to reach the inner side of the top piece 11 such that the combining bodies of the guide piece 12 and the receiving seat 13 are fitted into the top piece 11 so as to press and locate the cloth 16 to form a female member, which is disposed on the crown top of a cap. In the meantime, the male member is placed at the bottom of the cap before the male member is exerted on by a pressure of a greater magnitude. An insertion needle 14*a* is inserted into a guide slot 13*a* of the receiving seat 13 such that the needle is caused to curve along the arcuate inner wall of the guide piece 12. As a result, the male and the female members are fastened and located at the crown top of a cap.

Such a prior art cap crown button as described above is high in production cost and installing cost. As a result, the cap crown button of a plastic material was introduced. As shown in FIG. 2, the plastic crown button comprises a female retaining body 21, a fastening element 22 and a male retaining body 23. The female retaining body 21 is provided with a hollow projection 21*a* having therein an inverted bevel hook 21*b*. The male retaining body 23 is provided centrally with a nail 23*a* having a circular groove 23*b*. The female retaining body 21 is wrapped with a decorative cloth before being fastened by the fastening element 22 to the center of the crown top of a cap. The female retaining body 21 is held by the nail 23*a* of the male retaining body 23.

Such a plastic crown button as described above is defective in design in that the female retaining body 21 can not be made easily, and that the effect of fastening the female retaining body 21 with the male retaining body 23 is relatively poor, and further that the wrinkles in the decorative cloth wrapping the female retaining body 21 undermine the esthetic effect of the crown button, and still further that the female retaining bodies 21 are bound to be so crammed in the automatic feeding device of a riveting machine that they can not be fed one by one into the riveting machine with precision.

SUMMARY OF THE INVENTION

It is therefore the primary objective of the present invention to provide a cap crown button, which overcomes all the shortcomings of the cap crown buttons of the prior art described above.

The objective of the present invention is accomplished by the cap crown button, which comprises a female retaining body, a decorating cloth, a fastening element, and a male retaining body. The female retaining body has an arcuate top, a periphery and a receiving space provided centrally with a projection facing downwards and having an axial hole which is provided therein with a shoulder. The projection has a belly portion. The female retainng body is covered with the decorating cloth. The fastening element is located in the receiving space such that the fastening element fastens the decorating cloth which extends into the receiving space. The male retaining body comprises a disklike bottom and a nail having thereon a tapered head capable of piercing the cap crown to engage the axial hole of the female retaining body.

DETAILED DESCRIPTION OF THE INVENTION

Figure 1:
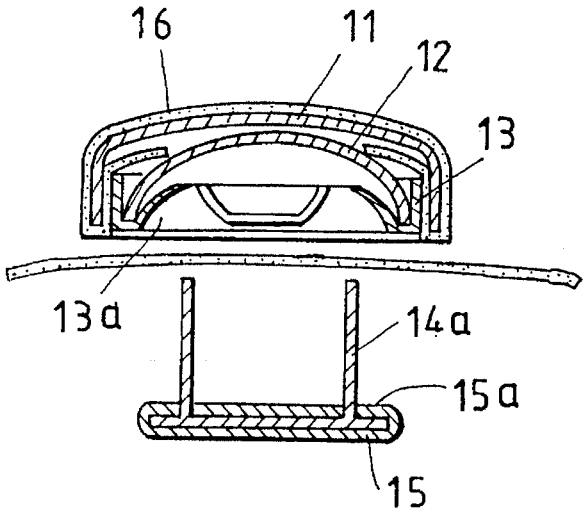
FIG. 1 PRIOR ART
FIG. 1 shows a sectional view of a cap crown button of the prior art.
Figure 2:
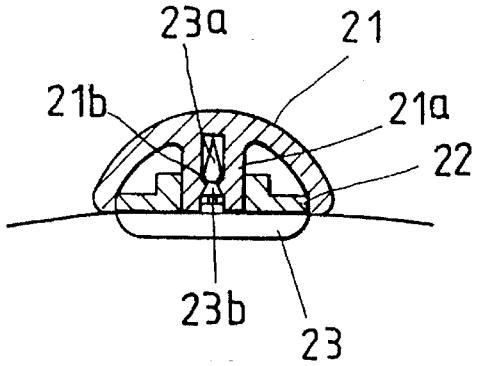
FIG. 2 PRIOR ART
FIG. 2 shows a sectional view of another cap crown button of the prior art.
Figure 3:
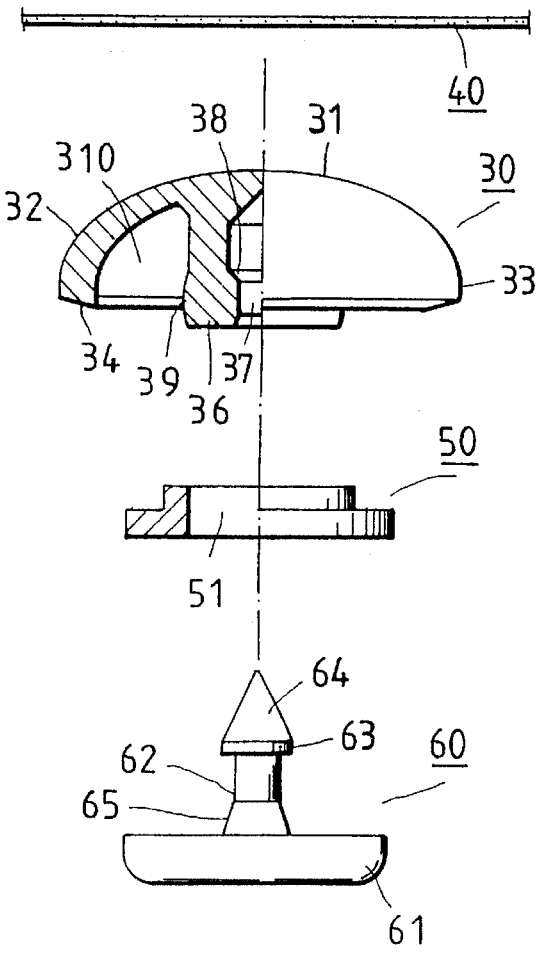
FIG. 3 shows an exploded view of a cap crown button of the present invention.
Figure 4:
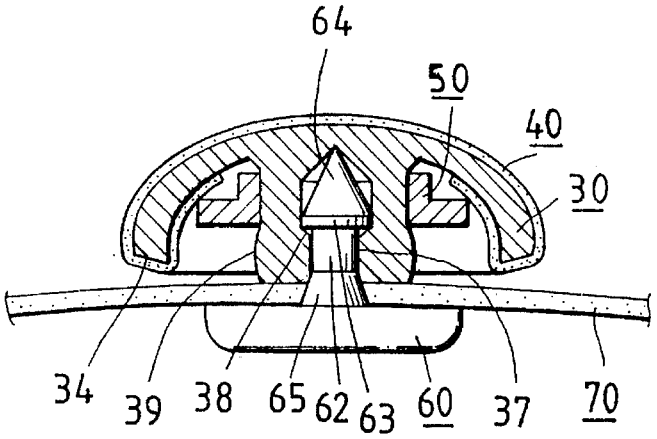
FIG. 4 shows a sectional view of the cap crown button in combination according to the present invention.

Referring to FIGS. 3 and 4, a cap crown button embodied in the present invention is shown comprising a female retaining body 30, a decorating cloth 40, a fastening element 50, and a male retaining body 60.

The female retaining body 30 is made integrally of a plastic material by injection molding and is provided at the top thereof with a smooth arcuate surface 31 having a periphery 32 and a receiving space 310. The periphery 32 has a precipitous portion 33 located at the lower segment thereof. Located under the periphery 32 is a pointed portion 34 becoming smaller toward the receiving space 310 which is provided centrally with a projection 36 facing downwards and having an axial hole 37 which has an upper segment greater in diameter than a lower segment thereof. The axial hole 37 is provided therein with a shoulder 38. The projection 36 has an arcuate belly portion 39.

The decorating cloth 40 of a soft fabric is slightly greater in size than the outer surface of the female retaining body 30 so as to enable the decorating cloth 40 to cover the arcuate surface 31 and the periphery 32 of the female retaining body 30 such that the tail end of the decorating cloth 40 is received in the receiving space 310.

The fastening element or cushion 50 is made integrally of a plastic material by injection molding and is provided with a through hole 51 corresponding in diameter to the projection 36 which is put through the through hole 51 to press against the decorating cloth 40 in the receiving space 310.

The male retaining body 60 is made integrally of a plastic material by injection molding and is composed of a disklike bottom 61 and a nail 62 extending upwards from the bottom 61 and having at the top end thereof a head 63 which is greater in diameter than the nail 62 and is provided thereon with a tapered portion 64 capable of piercing a cap crown 70 and of being retained securely in the axial hole 37 of the projection 36 of the female retaining body 30. The nail 62 is provided at the bottom end thereof with a tapered base 65.

In combination, the female retaining body 30 is covered with the decorating cloth 40 whose tail end is received in the receiving space 310. The projection 36 of the female retaining body 30 is fitted into the through hole 51 of the cushion 50. The cushoion 50 is forced through the belly portion 39 and pressed toward the top side of the receiving space 310 such that the cushion 50 is obstructed by the belly portion 39 and that the cushion 50 presses intensively against the tail end of the decorating cloth 40. The tapered portion 64 of the nail 62 of the male retaining body 60 is caused to pierce the top center of the cap crown 70. The female retaining body 30 is then exerted on by a pressure such that the axial hole 37 of the projection 36 of the female retaining body 30 engages the nail 62 of the male retaining body 60. The head 63 of the nail 62 is forced into the axial hole 37, which is then caused to enlarge in its outer diameter so as to force the cushion 50 to move into the receiving space 310 in which the decorating cloth 40 is fixed further, thereby resulting in the wrinkles of the decorating cloth 40 to appear on the pointed portion 34. In other words, the wrinkles of the decorating cloth 40 are concealed under the periphery 32 of the female retaining body 30. The nail 62 is continuously forced into the axial hole 37 such that the head 63 of the nail 62 is forced through the shoulder 38 of the axial hole 37, and that the lower end surface of the head 63 of the nail 62 is retained by the shoulder 38 of the axial hole 37. As a result, the male retaining body 60 is held securely by the female retaining body 30. The tapered base 65 of the nail 62 is attached to the inverted angle of the bottom end of the axial hole 37 so that the belly portion 39 of the projection 36 is able to urge continuously the cushion 50.

The cap crown button of the present invention is inherently superior to the prior art cap crown buttons in that the former can be made economically, and that the male retaining body of the present invention is held firmly by the female retaining body, and further that the belly portion of the female retaining body of the present invention is capable of urging the cushion so as to fix the decorating cloth firmly on the surface of the female retaining body, and still further that the wrinkles of the decorating cloth are effectively concealed under the belly portion of the female retaining body, and still further that the female retaining body is provided at the bottom segment thereof with a precipitous portion capable of preventing the cap crown buttons of the present invention from being crammed during the automatic feeding process.

What is claimed is:

1. A cap crown comprising:

a female retaining body made integrally of a plastic material by injection molding and provided at a top thereof with an arcuate surface having a periphery extending downwards and a receiving space which is provided centrally with a projection having an axial hole;

a decorating cloth of a soft fabric and covering said arcuate surface and said periphery of said female retaining body such that a tail end of said decorating cloth is received in said receiving space;

a fastening element made integrally of a plastic material by injection molding and being smaller in size than said receiving space of said female retaining body, said fastening element provided axially with a through hole dimensioned to receive therein said projection of said female retaining body; and a male retaining body made integrally of a plastic material by injection molding and composed of a bottom and a nail fastened centrally to said bottom;

wherein said axial hole of said projection has an upper segment greater in diameter than a lower segment thereof, and a shoulder; wherein said nail of said male retaining body is provided with a head and a tapered bottom, said head being greater in diameter than said nail and having thereon a tapered portion capable of piercing a cap crown to engage said axial hole of said projection of said female retaining body; and wherein said projection of said female retaining body is provided with a belly portion capable of urging said fastening element so as to fix firmly said decorating cloth and wherein said belly portion has a greatest belly diameter greater than a remainder of said projection of said female receiving body and also greater than an inner diameter of said through hole of said fastening element.

2. The cap crown button according to claim 1 wherein said female retaining body is provided under said periphery thereof with a pointed portion.

3. The cap crown button according to claim 1 wherein said female retaining body is provided at a lower segment thereof with a precipitous portion.

4. The cap crown button according to claim 1 wherein said male retaining body includes a tapered base intermediate said nail and said bottom, said tapered base increasing in a base diameter from said nail to said bottom and having a greatest base diameter greater than said inner diameter of said through hole, such that said tapered base acts to distend said belly portion when driven into said through hole.

5. The cap crown button according to claim 1 wherein said belly portion is partially spheroidal in shape.

* * * * *